United States Patent [19]

Childs

[11] 4,145,884

[45] Mar. 27, 1979

[54] REVERSIBLE POWER TRANSMISSION

[76] Inventor: Willard D. Childs, 582 Rancha Santa Fe Rd., Olivenhain, Calif. 92024

[21] Appl. No.: 818,427

[22] Filed: Jul. 25, 1977

[51] Int. Cl.[2] ..... F15B 13/09; F04B 23/04

[52] U.S. Cl. ..... 60/486; 417/426; 417/429

[58] Field of Search ..... 60/486, 487, 408; 417/216, 339, 426, 429, 515

[56] References Cited

U.S. PATENT DOCUMENTS

| | | | |
|---|---|---|---|
| 3,249,053 | 5/1966 | Govan | 417/339 X |
| 3,601,986 | 8/1971 | Becker | 417/426 X |
| 3,816,029 | 6/1974 | Bowen et al. | 417/539 X |

FOREIGN PATENT DOCUMENTS

| | | | |
|---|---|---|---|
| 1274851 | 5/1972 | United Kingdom | 60/486 |

*Primary Examiner*—Edgar W. Geoghegan
*Attorney, Agent, or Firm*—Frank D. Gilliam

[57] ABSTRACT

A reversible power transmission for transmitting input power supplied from either direction. The transmission comprises in combination a plurality of fluid power units for driving or receiving power from a first plurality of fluid actuators. The first plurality of fluid actuators are timed together for cooperating in a mutually complementary manner to substantially linearize a normally pulsating power transfer. The first plurality of actuators may be connected to additional actuators for providing or receiving rotary motion or to plungers operating within stuffing boxes for constant flow pumping or fluid power transfer.

3 Claims, 12 Drawing Figures

REVERSIBLE POWER TRANSMISSION

BACKGROUND OF THE INVENTION

This invention relates to a reversible power transmission suitable for transmitting power between a plurality of fluid actuators and a plurality of fluid power units, and more specifically to an energy converting device for transmitting or receiving fluid energy or rotary mechanical energy.

When used for positive displacement pumping this invention provides for minimal pulsation of the fluid when compared to present state of the art pumps which are limited by the mechanical geometry of their crank mechanism.

Present positive displacement pumps are usually reciprocating piston or plunger pumps, wherein pistons slide back and forth within cylinders or plungers slide back and forth within stuffing boxes to decrease and increase the working volume. Check valves control the entry into and the discharge from the working volume to create a flow by the alternating suction and discharge action of the piston and plunger.

To provide for a smoothing of the pulsating discharge flow, two working volumes are often located opposite one another with a common piston between to produce a double acting pump. The pulsating discharge flow may be further smoothed by adding short-time accumulators in the pipelines to dampen the peaks and fill in the valleys. Alternately, it is common practice to utilize several in-line cylinders operated by a common drive, each piston located at a different displaced position within its cylinder so that overlapping of the discharge strokes may smooth the total discharge flow.

Such positive displacement pumps have many uses and are specially suited for pumping fluids at high volumes, and pressures. Typical of such utilization would be in the pipeline transportation of oil, gas, or heavy slurries such as coal, iron ore, or limestone for example. Other typical uses would be for dredging sand, gravel, silt, and clay, pumping water, and compressing gases.

The advantages of the piston or plunger positive displacement pump include a good self-priming capability and relatively high energy efficiency, however, this efficiency could be improved by the elimination of the pulsating delivery flow. While the arrangements described above do smooth the delivery rate significantly, there still remains a degree of pulsation. Heavy fluids, such as drilling mud, represent considerable momentum once a column is put in motion, and the pulsating delivery of such a massive column results in an energy loss, whereas a constant flow rate would take advantage of the momentum of this moving column to yield an improvement in efficiency as well as reduce the fatigue on pipelines which must absorb this pulsed energy. Other disadvantages of present pumps, particularly those of the large variety, include large space requirements at the pump site, and heavy weight with its associated support structure requirements.

SUMMARY OF THE INVENTION

The present invention is concerned with providing a power transmission that can be used as a positive displacement pump (hereinafter referred to as the pump), which overcomes some of the disadvantages of present pumps, and it is an object of the invention to provide a pump which produces a smooth and constant flow which will efficiently transport a fluid along a pipeline without the energy losses associated with pulsating flow.

Another object of the invention is to provide a pump with reduced mounting space requirements at the pump site.

Another object of the invention is to provide a pump with reduced size requirements for the support structure of the pump.

Another object of the invention is to provide a pump with fewer alignment requirements by eliminating bearings, pillow blocks, cranks, connecting rods, gearing, and other mechanical driving means, and replacing them with hydraulic lines which have no such alignment requirements.

Another object of the invention is to provide a pump which may be driven by any desired power source operating at its most efficient constant speed by employing a variable speed drive of high efficiency at low flows or at full rated output to stroke said pump at the desired speed.

Another object of the invention is to provide a pump with a plurality of pistons and cylinders which may be disposed in any spatial relationship one to the other that is most adaptable to the space envelope available by eliminating any mechanical interconnection between the pistons, such as, for example, a crankshaft.

The above objects and others are accomplished with the present invention by utilizing a new and novel combination of elements interconnected in a manner to be hereinafter described.

BRIEF DESCRIPTION OF THE DRAWINGS

The advantages of the invention reside in the construction and cooperation of the parts hereinafter described, reference being made to the accompanying drawings forming a part of this disclosure, wherein several embodiments of the invention are shown by way of examples and wherein like numbers designate like parts throughout the various figures.

DETAILED DESCRIPTION OF THE INVENTION

Figure 1:
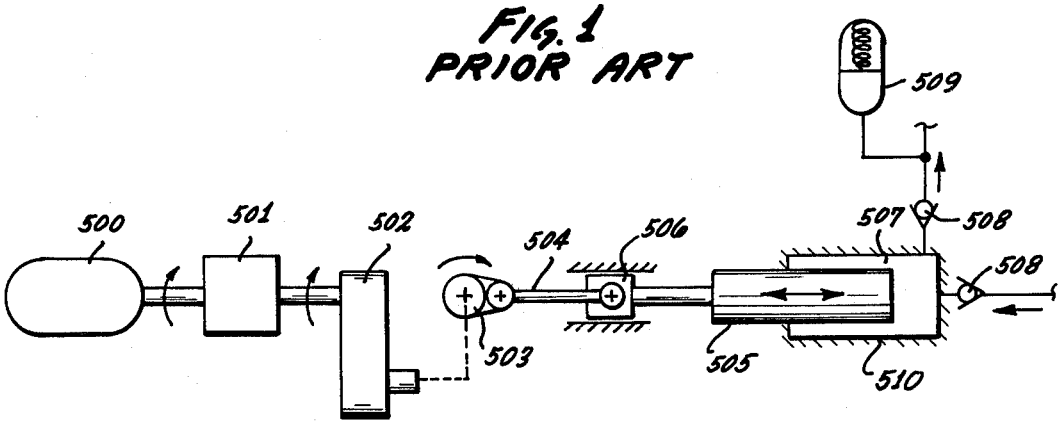
FIG. 1 PRIOR ART
FIG. 1 illustrates a typical prior art pumping device.

Referring now to the drawings in detail, FIG. 1 schematically illustrates a typical prior art device, wherein a motor or engine 500 rotates an input shaft of a variable speed drive 501. The variable speed drive output is then reduced by a fixed gear reduction in speed reducer 502, which in turn rotates crankshaft 503. Journaled to crankshaft 503 are a plurality of connecting rods 504, each pivotally attached to their respective plungers 505. A slide block 506 converts the rotation of crankshaft 503 into reciprocating motion of plunger 505 which thereby moves in and out of stuffing box 506 to decrease and increase the working volume 507. Check valves 508 control the fluid entry into and discharge from the working volume 507. Communicating with the discharge line is an accumulator or damper 509 which is sometimes utilized to partially smooth out the surges or pulsations in the discharge line by accepting fluid during flow peaks and discharging fluid during flow valleys.

Figure 2:
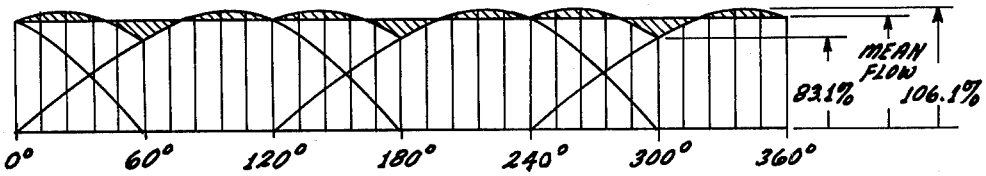
FIG. 2 PRIOR ART
FIG. 2 is a diagram of total discharge flow from a prior art triplex reciprocating pump during one complete revolution.

FIG. 2 is a graph of discharge flow from a triplex pump such as that shown in FIG. 1, wherein three plungers 505 and stuffing boxes 510 are located adjacent and in-line with one another and are connected to crankshaft 503 at equally spaced distances of 120° around the crankshaft center-line. Each plunger will cause discharge flow from its stuffing box for 180° of crank rotation, from top dead center to bottom dead center. As can be seen from the graph, the first plunger strokes during the first 180° of rotation, starting from zero flow at 0° and rising to a maximum flow at 90° and then dropping back to zero flow at 180°. In a like manner the second plunger strokes from the 120° rotation point to the 300° rotation point, and the third plunger strokes from 240° rotation to 60° rotation. By adding the discharge flow from each of the three stuffing boxes for each degree of crankshaft rotation the total discharge flow is determined and plotted as the top line on the graph. This line defines six humps in the total discharge flow during one revolution. The total discharge for one revolution of the crankshaft is determined and the mean flow value are shown as shaded areas, the peaks being 6.1% above and the valleys 16.9% below mean flow. Thus the total pulsation or variation from mean flow is 23%.

If a fourth stuffing box is added to the pump, the total variation from mean flow becomes worse and totals 32.5%. Five stuffing boxes yield a total variation of 7.1%, six yield 14.0% and seven yield 4.0%. Thus it can be seen that combinations of an uneven number of stuffing boxes will yield the lowest variation from mean flow. Nine stuffing boxes will provide a discharge flow varying only 2.2% from the mean flow and would for most applications be satisfactory, however, nine plungers and stuffing boxes with the associated hardware and plumbing comprise a pump of unsatisfactory dimensions and complications, and for most applications a triplex pump is utilized.

It should be noted that these flows are determined by the geometry of the connecting rod and its crank on the crankshaft since discharge flow is directly proportional to plunger displacement and discharge flow rate is directly proportional to plunger linear velocity. At top dead center angular movement of the crank produces little linear displacement of stroke of the plunger. At the 90° position angular movement of the crank produces maximum linear displacement of the plunger and as the crank approaches the 180° position, or bottom dead center, the angular movement again produces minimum plunger displacement. This is inherent in a conventional reciprocating pump. In a like manner it may be seen that for a given constant torque in the crankshaft, maximum linear force to the plunger is imposed at dead center and minimum force at the 90 position where the moment arm is maximum (force = torque/arm) thereby resulting in a plunger capable of producing maximum pressure at the minimum flow rate position and minimum pressure at the maximum flow rate position.

Figure 3:
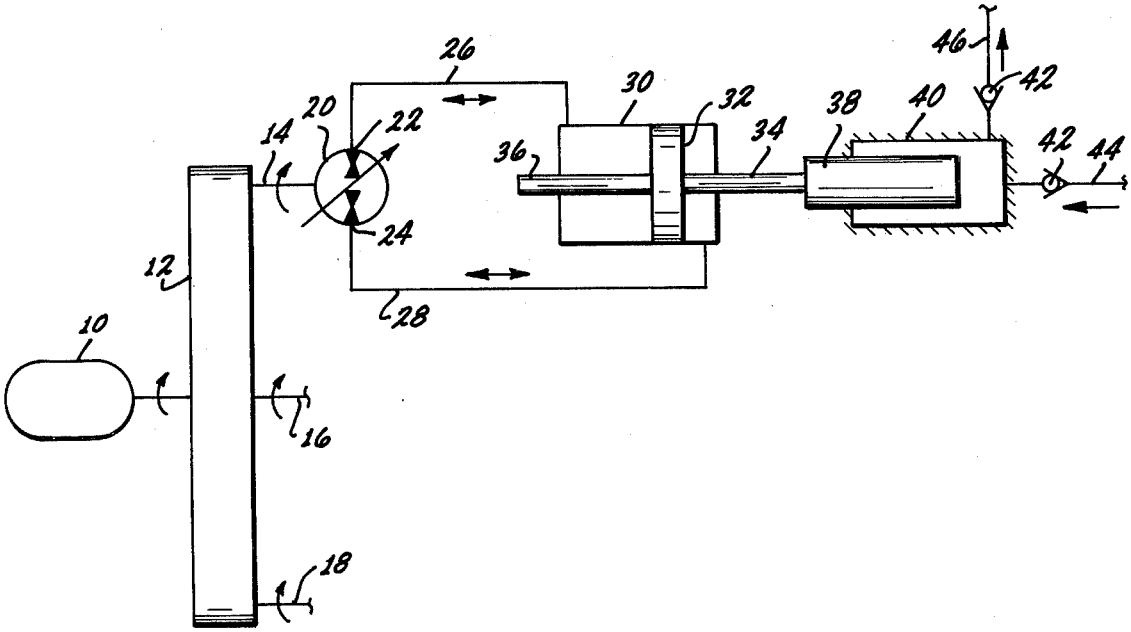
FIG. 3 is a schematic presentation of the present invention utilizing plungers and stuffing boxes.

FIG. 3 is a simplified schematic showing the major elements of the present invention. The pump is driven by any suitable engine or motor 10, such as for example an electric motor, internal combustion engine, turbine engine, or steam engine. Motor 10 is connected to a transmission or power splitter 12 which for illustrative purposes has three power takeoff shafts 14, 16, and 18. For clarity only the system driven by power takeoff 14 is shown, since takeoffs 16 and 18 each drive a similar system. Connected to power takeoff 14 is a variable volume positive displacement hydraulic power unit 20, having ports 22 and 24. Power unit 20 is a device that can on command produce zero to full hydraulic discharge flow from either port 22 or 24 as will be described in more detail hereinafter.

Hydraulic line 26 connects port 22 of hydraulic power unit 20 to one end of cylinder 30, and hydraulic line 28 connects port 24 to the opposite end of cylinder 30. Located in cylinder 30 is piston 32, and connected to opposite sides of piston 32 are piston rods 34 and 36, thereby producing a double-acting piston 32 operating in a closed loop with hydraulic power unit 20. A plunger 38 is connected to piston rod 34 and fits within stuffing box 40, which in turn is connected to suction pipe 44 and discharge pipe 46. Located in pipes 44 and 46 are check valves 42 which control fluid flow into and out of stuffing box 40.

Linear displacement of double-acting piston 32 in cylinder 30 causes the exact same linear displacement of plunger 38 in stuffing box 40. The stroke velocity of piston 32 is controlled by the hydraulic fluid delivery rate of hydraulic power unit 20 which is variable and reversible. Thus it may be seen that the three plungers 38, each connected by means of similar drive trains to shafts 14, 16, and 18 of transmission 12 are, by virtue of their own variable hydraulic power units 20, each independent of one another in their respective displaced positions and stroke velocity, and are unencumbered by any fixed geometric relationships.

Figure 4:
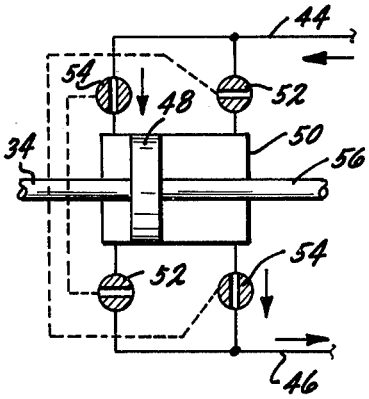
FIG. 4 is a partial schematic of the present invention employing double-acting pistons and cylinders.

In FIG. 4 is shown that portion of the pump which differs from the device shown in FIG. 3 wherein a different type piston 48 is connected to rod 34 of FIG. 3. In this embodiment double-acting piston 48 replaces plunger 38, and the two check valves 42 are replaced by four directional valves 52 and 54. As piston 48 strokes to the right valves 52 are closed and valves 54 are open as shown, and when piston 48 strokes to the left valves 52 are open and valves 54 are closed. These four valves are slide valves that are actuated in relationship to the linear displacement of rod 34. These valves may be any directional valves such as check valves, two-way valves, three-way valves, four-way valves, suitable for the application. It also should be noted that piston 48 is the same size as piston 32 of FIG. 3 so that the hydraulic pressure acting on piston 32 would cause a similar pressure to be imposed on the pumped fluid in cylinder 50 by piston 48, whereas the plunger 38 of FIG. 3 is of smaller area than piston 32 and would thereby impose a greater pressure on the fluid in stuffing box 40 than the hydraulic pressure exerted in cylinder 30 on piston 32. Thus it may be seen that the sizing of the two pistons relative to each other may be varied to suit the intended purpose, and that either plungers, single-acting pistons, or double-acting pistons may comprise the final stage of the pump. Hereinafter the final stage will be referred to as a plunger/stuffing box embodiment to more clearly differentiate the final stage from the hydraulic piston 32/cylinder 30, but it should be realized that any of the other embodiments are also intended to be included.

Figure 5:
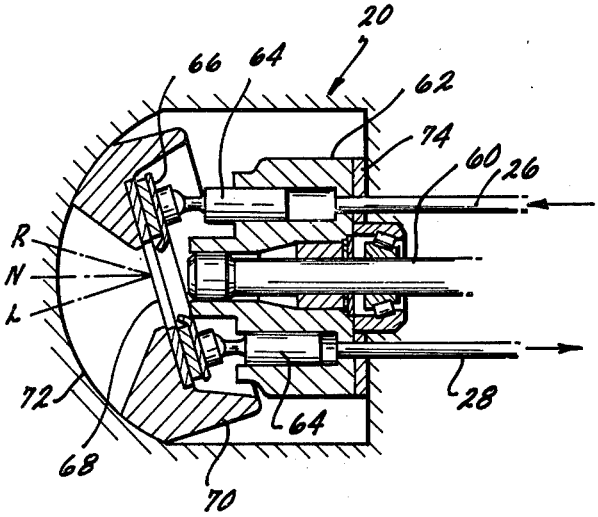
FIG. 5 is a schematic cross-section view of the hydraulic power unit.

Referring now to FIG. 5 wherein a cross-section of a typical hydraulic power unit 20 is shown so that the operation of this unit may be more clearly understood. Any suitable variable displacement power unit may be used such as rotary vane, in-line and bent-axis axial piston, radial piston, or plunger, for example. For clarity a specific unit, the in-line axial piston with movable cam angle, is shown, but it should be understood that other power units may also be utilized equally as well. An input shaft 60 is splined to a barrel 62 which carries a plurality of axial pistons 64. Each pistons 64 terminates in a bail on which is swaged a shoe 66 that is free to pivot as well as rotate at each piston ball. The shoe 66 bears against a thrust plate 68, sometimes referred to as a creep plate by those skilled in the art, which in turn bears against the flat surface of cam 70, which is shown angled to the axis of shaft 60. The thrust plate 68 rotates slowly when barrel 62 and shoe 66 rotate at shaft speed, thereby distributing the wear between shoe 66 and cam 70. Cam 70 is fixed and does not rotate, but it can be tilted around an axis perpendicular to the shaft 60 axis. Rotation of the shaft 60 and barrel 62 causes the pistons 64 to reciprocate smoothly as they follow the cam surface of cam 70. Those pistons moving into their respective bores in barrel 62 displace fluid out of the discharge port into line 28, while those pistons 64 moving out of their respective bores draw fluid from inlet line 26. Located on the end of barrel 62 is a fixed port plate 74, which may be more clearly seen in FIG. 6.

Figure 6:
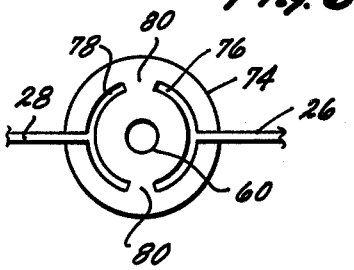
FIG. 6 is an end view of the valve plate of the hydraulic power unit.

In FIG. 6 it will be seen that port plate 74 contains two arcuate port openings 76 and 78, separated by land areas 80. Port 76 is connected to inlet line 26, and port 78 is connected to discharge line 28. With input shaft 60 and barrel 62 rotating in a counterclockwise direction when viewed from the port plate end of the unit the pistons 64 in communication with port opening 76 are moving out of their bores and drawing fluid from inlet line 26, while pistons moving into their respective bores are in communication with port opening 78 and are discharging fluid into line 28. The pistons 64 at top and bottom dead center have no axial movement and at that time their bore in barrel 62 is sealed by the land areas 80 in port plate 74. The angle of the cam surface determines the magnitude of piston stroke and the delivery flow of the unit. The cam is positioned in the left position as designated by the letter L in FIG. 5 and will thereby cause piston 32 of FIG. 3 to move toward the left. When the cam angle relative to the axis of shaft 60 is reduced to zero there is no displacement of pistons 64 and the unit is in neutral, designated by the letter N. When the cam angle is reversed to position R, line 26 becomes the discharge line and line 28 is the inlet line thereby causing piston 32 of FIG. 3 to move to the right. Thus it can be seen that discharge flow from the hydraulic power unit while driven at a constant rotation speed by shaft 60 may be changed from a maximum value in one direction smoothly through zero to a maximum value in the opposite direction as the cam angle goes from one side of center through neutral to the other side.

Figure 7:
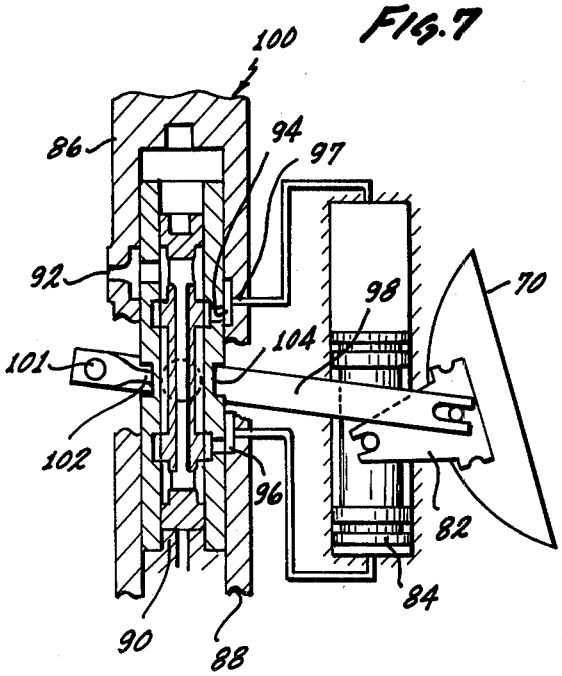
FIG. 7 is a schematic presentation of the servo employed to control displacement angle of the rocker cam.
Figure 8:
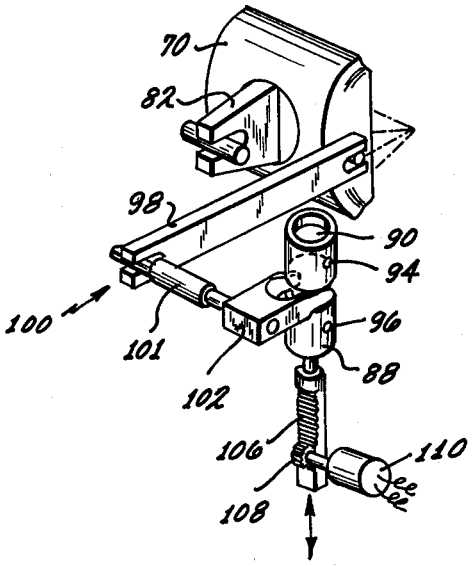
FIG. 8 is a perspective view of the servo of FIG. 7.

FIGS. 7 and 8 schematically illustrate the hydraulic servo 100 employed to control the angle of cam 70. Stroking clevis 82 is attached to cam 70 and the stroking piston 84 in such a manner that the displacement of stroking piston 84 causes cam 70 to pivot and thereby change the cam surface angle. Hydraulic lines communicate from each end of stroking piston 84 to ports in servo cylinder 86. Located within the servo cylinder is a hollow servo sleeve 88 and located within the servo sleeve 88 is a servo spool 90. Hydraulic fluid is supplied by means of port 92 to both ends of the spool 90 so that the spool is hydraulically balanced and capable of being shifted by a low power linear input. As illustrated in FIG. 7 the spool 90 has both ports 94 and 96 closed, and the cam 70 is in the commanded position. If the spool 90 is shifted upward the upper port 94 is opened to drain chamber 97 which communicates with an outlet port, not visible, thru cylinder 86. At the same time the lower port 96 is opened and hydraulic fluid will flow from port 92 down the bore in spool 90 out port 96 and to the lower side of stroking piston 84, causing it to stroke upward thereby tilting cam 70. As cam 70 pivots it rotates feedback link 98 around pivot 101, which also rotates feedback clevis arm 102 which is connected to servo sleeve 88 by means of groove 104, thereby moving servo sleeve 88 upward until the upper port 94 and lower port 96 are again closed off at the commanded cam angle called for by the servo spool 90.

FIG. 8 is a perspective view of the servo 100 of FIG. 7 where additionally is shown a rack 106, pinion 108, and actuating motor 110 which drives spool 90 to a command position determined by a signal magnitude and polarity received by motor 110. No electrical feedback of cam angle is required for angular control since this is accomplished hydraulically by feedback link 98.

Figure 9:
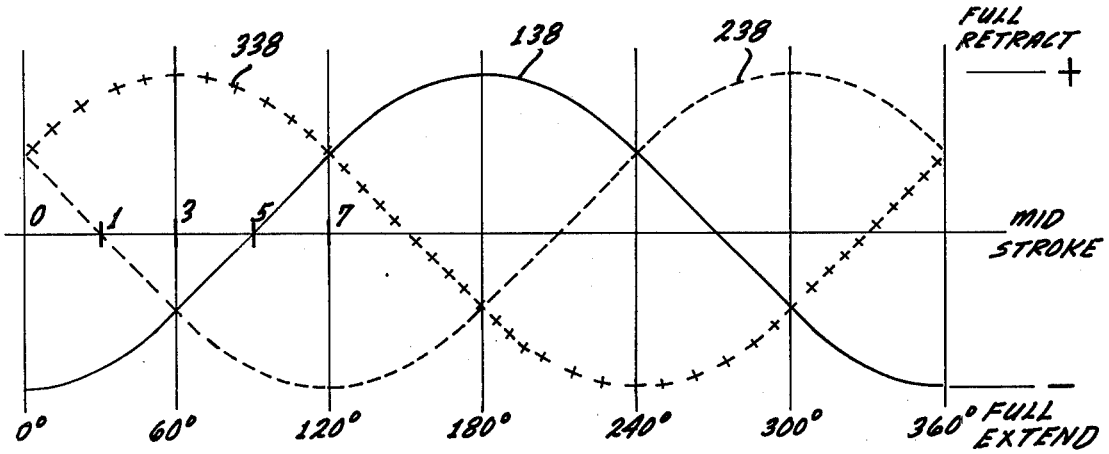
FIG. 9 is a graphic presentation of the stroke displacement versus time of three plungers during one cycle of the pump.
Figure 10:
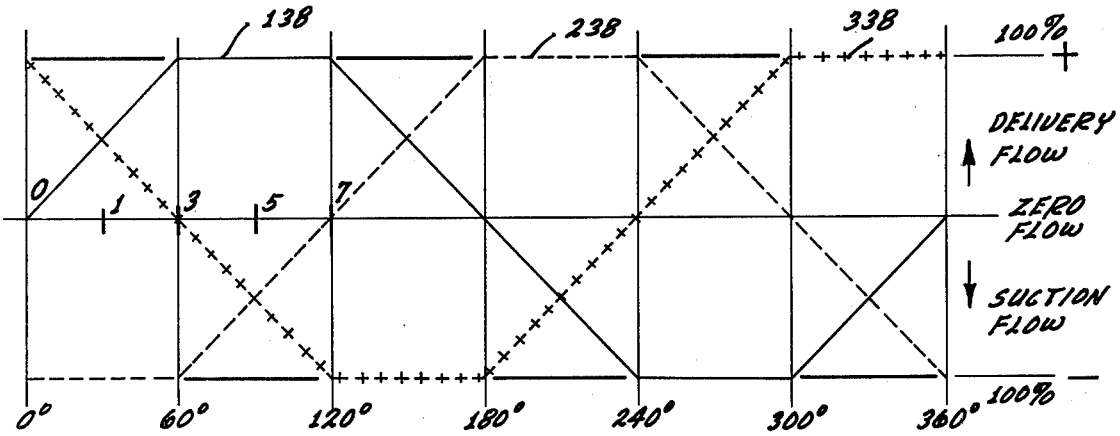
FIG. 10 is a graphic presentation of the delivery and suction flow from three plungers during one cycle of the pump.

Referring now to FIGS. 9, 10, and 3 it may be understood how the present invention delivers a steady and pulseless flow in a pipeline. FIG. 9 depicts in graph form the stroke displacement of each piston 32 and plunger 38 in a triplex configuration pump during one full pump cycle, while FIG. 10 shows the delivery flow and suction flow corresponding with the stroke displacements of plungers 38 shown in FIG. 9, wherein the first plunger is designated 138, the second 238, and the third 338. The curves of FIGS. 9 and 10 are plotted as a function of time which has been calibrated in degrees of rotation of a constant speed wheel or crankshaft wherein one revolution is of the same time period as one cycle of plunger 38, so that the curves may be more easily compared with the prior art curves shown in FIG. 2.

At time point zero plunger 138 is fully extended and the delivery flow is zero. The cam angle of variable hydraulic power unit 20 is at zero, and as the cam angle increases the hydraulic power unit 20 begins to deliver hydraulic fluid to the retract pressure side of piston 32 by means of line 26, causing plunger 38 to move to the right and into stuffing box 40 and thereby start delivery flow thru check valve 42 into delivery pipeline 46. The displacement rate of plunger 138 is increasing in a constant manner causing delivery flow to increase in a straight line, such that at time point 1 (30°) the delivery flow is half of maximum flow and at time point 3 (60°)

the delivery flow is maximum, and the cam angle of hydraulic power unit 20 has arrived at maximum. At time point 5 (90°) plunger 138 is at midstroke and still at maximum delivery stroke rate. At time point 7 (120°) the cam angle in hydraulic power unit 20 begins to decrease causing the stroke rate of plunger 138 to start decreasing, and the delivery rate also starts a steady decrease until at time 180° the cam angle in power unit 20 has arrived at neutral position, stopping hydraulic flow to piston 32 and causing the retract stroke of plunger 138 to stop, which thereby causes delivery flow from 138 to be zero. As the cam angle in power unit 20 passes thru neutral hydraulic fluid is discharged into line 28 causing plunger 138 to start movement to the left which commences the extend or suction stroke which draws fluid thru check valve 42 from pipeline 44. The suction flow steadily increases in a straight line manner until time point 240° where it arrives at maximum suction flow which is maintained until time point 300°, where it thereafter decreases until reaching zero at 360°.

The stroke and flow curves of plungers 238 and 338 are similarly shaped, each displaced one from the other by a time period of 120°. The total flow from the pump device is the total of flows from plungers 138 plus 238 plus 338. At time point 1 (30°) the delivery flow from 138 is half maximum as is the delivery flow from 338, and at time point 5 (90°) the suction flow of 238 is one-half of maximum as is the suction flow of 338, the total of each of the flows being shown as a heavy solid line. Thus it may be seen that the cam angle in each of the variable displacement hydraulic power units 20 are programmed in such a manner to regulate the stroke displacements of their respective plungers 138, 238, and 338 to produce a constant and pulseless total delivery flow and suction flow from the pump device.

Figure 11:
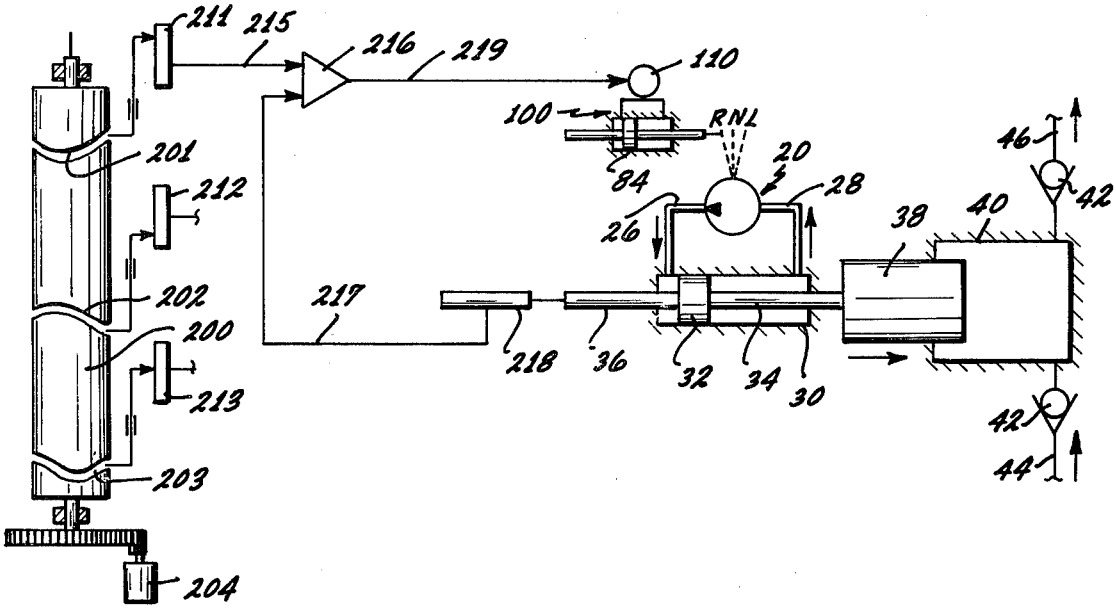
FIG. 11 is a schematic presentation showing additional elements of the present invention.

FIG. 11 is a schematic of the pump device showing certain of the control elements for a triplex configuration. A plurality of stacked cams, or a cam drum 200 having any suitable type of cam surfaces disposed thereon, such as for example cam grooves 201, 202, and 203, is rotated by a motor 204 which is speed controllable so that cam drum 200 may be rotated at the speed required for the intended purpose. A cam follower in groove 201 is linked to a signal generator 211 which sends a signal 215 thru amplifier 216 to motor 110, the output voltage varying in magnitude and polarity as prescribed by cam groove 201 to drive the motor 110, previously described and shown in FIG. 8, to position stroking piston 84 for the commanded angle of cam 70 in hydraulic power unit 20. As shown the cam is at position R which causes hydraulic fluid to pressurize line 26 and thereby move plunger 38 to the right into stuffing box 40. The piston rod 36 is connected to a linear or rotary position sensor on potentiometer 218 which sends a feedback signal 217 to error amplifier 216. This feedback signal 217 is compared with the command signal 215, and if the piston 32 is not at the displacement position commanded for that instant of time the error amplifier augments the command signal 215 and sends this signal 219 to motor 110. In a like manner the second plunger 38 is programmed by cam groove 202 and the third plunger 38 is programmed by groove 203. Where the intended purpose of the pump device doesn't require the error signal 217 feedback or mechanical actuation is desired, the cam follower engaged in the cam groove may be mechanically attached to servo spool 90 to replace rack 106, thereby permitting the spool 90 to be moved directly by cam roller 200. Any other suitable timing means may be used equally as well to practice the invention.

From the foregoing description it may be seen that the stroke versus time of each of the three plungers in a triplex pump embodiment of the present invention may be programmed to produce complementary flows whose sum totals to a constant flow at any point in the pump cycle, thereby eliminating any significant pulsation in either the suction or discharge flow. It should also be appreciated that this technique may be employed in a pump of any number of plungers in the final stage. There are applications for the technique in a single or double plunger pump where a specific stroke versus time sequence is desired that can't be obtained by a rotating crank geometry. The variable flow positive displacement hydraulic power unit 20 produces a flow of constant pressure which means that at any point in the stroke of plunger 38 the pressure is constant, not varying with crankshaft rotation as prior art pumps do. In pumps that have long strokes (large crank throws) this pressure variation can be significant, making the disclosed invention a distinct improvement over the prior art and has application to an embodiment comprising a single plunger or a plurality of plungers.

Only the piston 32 and plunger 38 portion of the pump need be installed at the pump site while the driving motor 10 and variable flow hydraulic power unit 20 may be located remotely, the only connections between the two installations comprising control elements and hydraulic lines. Thus the volume and weight of the installation at the pipeline site may be significantly reduced, thereby reducing the complexities of the pump support structure. Precision alignment of mechanical drive elements such as bearings, pillow blocks, drive shafts, and connecting rods, is not required. This also reduces the complexities of the pump support structure.

Also it should be realized that the present invention allows complete flexibility in the mounting arrangement of said stuffing boxes. Prior art pumps arranged the stuffing boxes in-line to accommodate a common crankshaft, and the stuffing boxes or cylinders were bored in a common heavy cylinder block. With the present invention each stuffing box may be mounted in any desired relationship with and any desired distance from other stuffing boxes, such as in a circular dispersal pattern, triangular pattern, or rectangular pattern, because there are no mechanical interconnections between stuffing boxes. This reduces the pump space allocation problem on original installation, and allows for ease of access to the individual cylinders or stuffing boxes for maintenance. It is possible to shut down one stuffing box for repair or service without the need to shut down the entire pump. It is even possible to put a spare stuffing box on the line to replace the stuffing box down for repair.

Figure 12:
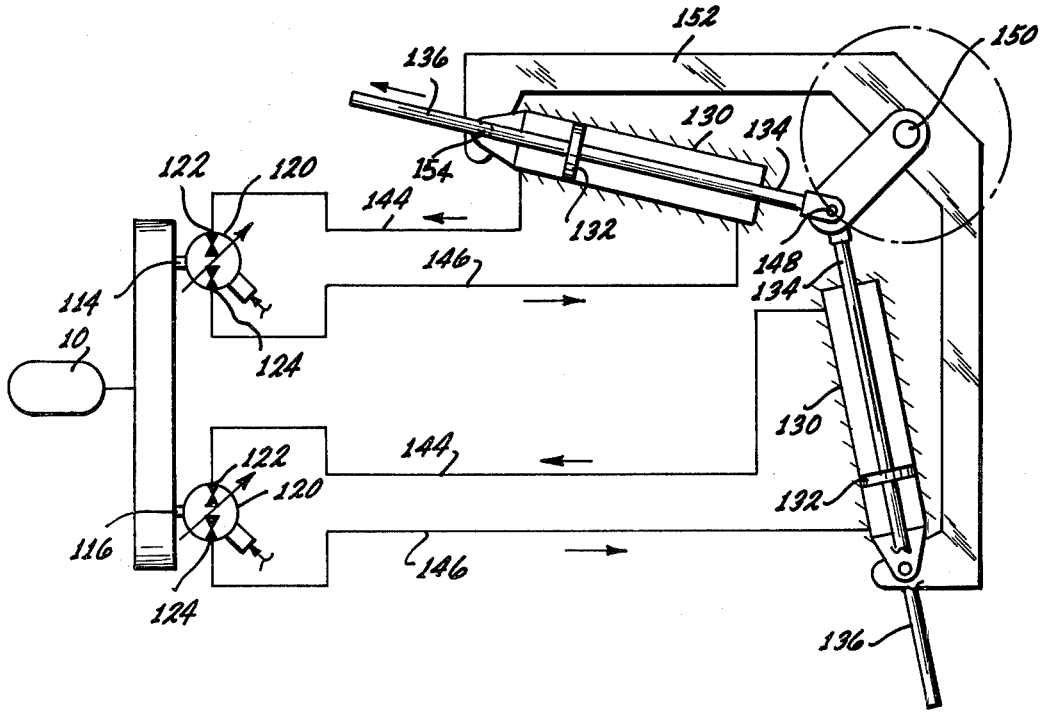
FIG. 12 is a schematic presentation of the present invention providing rotary to rotary power transmission.

In FIG. 12 there is shown an embodiment of the invention wherein rotary power is supplied to the device and rotary power is supplied at its output. The rotational speeds of the input power and output power can be varied over a wide range of different speeds. A motor 10 drives or is driven through shafts 114, 116. These shafts 114, 116, either drive or are driven by variable volume positive displacement hydraulic power units 120 having ports 122, 124. Hydraulic line 144 connects port 122 of hydraulic power unit 120 to one end of cylinder 120 and hydraulic line 146 connects port 124 to the opposite end of cylinder 130. Located in cylinder 130 is a piston 132 and piston rods 134, 136, thereby providing a doubleacting piston 130 operating in a closed loop with hydraulic power unit 120. Piston rods 134 are pivotally connected at 148 to a throw or crank arm fixedly attached to a crankshaft 150. The arm and crank are supported by a structural bracket 152 or the like. A timing means, such as hereinbefore discussed, is connected to the power units to synchronize their output or input power with the rotational position of crank 150 so as to even the power transfer between the pistons and crank rotation, and power units will be uniform. The outer ends of cylinder 130 are pivotally attached to bracket 152 so that they can rotate about attachment point 154 while the piston rods slide in and out in a sealed engagement with their respective cylinders.

Further, it should be understood that embodiments of the invention having pistons and cylinders for the final stage, such as the arrangement shown in FIG. 4 may be used in a reversed manner whereby a fluid under pressure in pipline 44 of FIG. 4 may be used to drive pistons 48 which will in turn rotate power units 20 as motors, resulting in rotation of shafts 14, 16 and 18, which would thereby cause motor 10 to become a generator. It also should be realized that another embodiment of the invention may be utilized wherein one or more pistons 32, of FIG. 3, are connected to a crank instead of plungers 38 by replacing piston rods 34 with connecting rods pivotally attached to pistons 32 to drive a rotating shaft whose speed could be controlled by hydraulic power units 20.

From the foregoing description of the construction and arrangement of the power transmission device it is clear to one skilled in the art that the objects of the invention have been accomplished. Additionally, other arrangements, applications, and modifications of the embodiment herein described will become apparent to those skilled in the art upon reading this disclosure, and these are intended to be included in this disclosure, it being understood that the preceding description is by way of example and is not to be taken as any limitation, the scope of this invention being limited only the claims.

I claim:

1. A reversible power transmission comprising:

a plurality of power units each having separate mechanical and hydraulic connections, said separate mechanical connections of each power unit connected to a common mechanical connection;

a plurality of hydraulic cylinders, at least one of said cylinders connected to said hydraulic connections of one of said power units;

a plurality of pistons, one piston sealably fitted in one of each of said cylinders for reciprocating therein;

a plurality of stuffing boxes;

a plurality of plungers, one connected to one of said pistons and located within each one of said stuffing boxes for reciprocating therein;

a source of fluid;

said stuffing boxes each having an input from said source of fluid and a common discharge conduit for discharging said fluid from said stuffing box;

valve means associated with the inputs and said common discharge conduit whereby fluid flow is controlled;

said plurality of power units are operable in a first mode of operation wherein an external source of mechanical power is applied through said common mechanical connection causing said plungers to reciprocate in a manner that draws fluid from said source into said stuffing boxes and expels said fluid from said stuffing boxes through said common discharge conduit, and a second mode of operation wherein said fluid under pressure is admitted into and discharged from said stuffing boxes causing reciprocation of said plungers within each of said stuffing boxes for providing a mechanical power output at said common mechanical connection; and timing means for programming each of said power units by plunger position feedback means when operating in said first mode for providing a complementary flow of fluid from said source and said common discharge conduit and when operating in said second mode for providing a complementary flow of power from said common mechanical connection.

2. A fluid transfer apparatus comprising:

three stuffing boxes having connections for receiving and discharging fluids;

valving means associated with said input and output connections for controlling the direction of fluid flow through said stuffing boxes;

a translatable plunger member within each stuffing box;

external power means for translating the plunger members within said stuffing boxes, each of said plunger members translate through a combined fluid input and output cycle, the inlet for each plunger member comprises a zero to maximum inlet flow during substantially the first 1/6 of the combined cycle, maximum inlet flow for substantially the second 1/6 of the combined cycle and from maximum to zero inlet flow for substantially the third 1/6 of the combined cycle, said output cycle comprises a zero to maximum output flow during substantially the fourth 1/6 of the combined cycle, maximum output flow for substantially the fifth 1/6 of the combined cycle, and from maximum to zero output flow for substantially the sixth 1/6 of the combined cycle, said plunger members operate in a ⅓ combined cycle spaced apart relationship.

3. A reversible power transmission comprising:

a plurality of power units each having separate mechanical and hydraulic connections, said separate mechanical connection of each power unit being connected to a common mechanical connection;

a plurality of hydraulic cylinders, at least one of said cylinders connected to said fluid connections of one of said power units;

a plurality of pistons, one piston sealably fitted in each one of said cylinders for reciprocating therein;

a plurality of piston rods, one end of each piston rod connected to a piston and the other end pivotally connected to a common crank;

said plurality of power units are operable in a first mode wherein an external mechanical power source is supplied to said common mechanical connections for supplying power to each power unit causing said pistons to reciprocate in a manner for rotating said crank and a second mode wherein mechanical power is applied to said crank for producing mechanical power at said common connection; and timing means for programming each of said power units by feedback means whereby complementary output power is transferred to said crank in the first mode and to said common mechanical connection in the second mode.

* * * * *